US007793600B2

(12) United States Patent
Dunstan

(10) Patent No.: US 7,793,600 B2
(45) Date of Patent: Sep. 14, 2010

(54) SECURITY DOOR AND FRAME CONSTRUCTION

(75) Inventor: Brett Dunstan, Doveton (AU)

(73) Assignee: Lokaway Pty. Ltd., Hallam (AU)

( * ) Notice: Subject to any disclaimer, the term of this patent is extended or adjusted under 35 U.S.C. 154(b) by 0 days.

(21) Appl. No.: 12/220,301

(22) Filed: Jul. 23, 2008

(65) Prior Publication Data

US 2009/0064908 A1 Mar. 12, 2009

Related U.S. Application Data

(62) Division of application No. 10/530,467, filed as application No. PCT/AU03/01321 on Oct. 8, 2003, now Pat. No. 7,404,363.

(30) Foreign Application Priority Data

Oct. 9, 2002 (AU) ..... 2002951987
Apr. 30, 2003 (AU) ..... 2003902027

(51) Int. Cl.
*E06B 3/50* (2006.01)

(52) U.S. Cl. ..... 109/70; 16/239; 49/254; 109/74; 312/139.1

(58) Field of Classification Search ..... 109/69–74; 49/324, 358, 254, 257, 258, 394; 16/242, 16/239; 312/139.1, 326, 329; 292/63, 196, 292/DIG. 17; 220/1.5, 833, 834, 835
See application file for complete search history.

(56) References Cited

U.S. PATENT DOCUMENTS

| | | | |
|---|---|---|---|
| 825,253 | A | 7/1906 | Watson |
| 915,397 | A | 3/1909 | Weiss |
| 958,624 | A | 5/1910 | Glazier |
| 990,469 | A | 4/1911 | Anderson |
| 1,873,522 | A | 8/1932 | Abbott et al. |
| 2,936,206 | A | 5/1960 | Wilmer et al. |
| 3,270,462 | A | 9/1966 | Obadal et al. |
| 3,481,288 | A | 12/1969 | Teleky |

(Continued)

FOREIGN PATENT DOCUMENTS

| | | |
|---|---|---|
| AU | A-17475/88 | 6/1988 |

(Continued)

*Primary Examiner*—Lloyd A Gall
(74) *Attorney, Agent, or Firm*—D. Peter Hochberg; Sean F. Mellino; Daniel J. Smola

(57) ABSTRACT

This security door construction is applicable to safes, factory doors and house doors. An offset hinge assembly allows the door to swing open and closed and also to slide in and out of a door slot in the door frame at the closing edge of the door. In the construction of a safe, hooks on the inside of the door enter slots in upstands inside the safe and engage and disengage through the sliding motion. One pair of hinges is fixed to the frame and the second pair of hinges is fixed to the door. The frame and door pairs are connected by a rod or tube which ensures that the hinge axis of the door pair remains parallel to the hinge axis of the frame pair. A handwheel is mounted on the door which turns a crank between stops and a link reacts against the rod causing the door to slide easily to LEFT or RIGHT. A spring overcomes resistance to initial movement.

42 Claims, 15 Drawing Sheets

U.S. PATENT DOCUMENTS

| | | | | |
|---|---|---|---|---|
| 3,788,689 | A | 1/1974 | Lloyd | |
| 4,070,074 | A | 1/1978 | Rohme | |
| 4,262,447 | A | 4/1981 | Schneier et al. | |
| 4,294,040 | A | 10/1981 | Crotti | |
| 4,367,684 | A | 1/1983 | Jucker | |
| 4,372,603 | A * | 2/1983 | Stanczak et al. | 296/146.12 |
| 4,548,330 | A | 10/1985 | Hewitt et al. | |
| 4,679,353 | A | 7/1987 | Langenbach et al. | |
| 4,704,970 | A | 11/1987 | Sanderson et al. | |
| 4,712,490 | A | 12/1987 | Lichter | |
| 4,852,503 | A | 8/1989 | Lichter | |
| 4,932,160 | A | 6/1990 | Sperko | |
| 5,056,262 | A | 10/1991 | Schweiss et al. | |
| 5,931,104 | A | 8/1999 | Horn et al. | |
| 5,953,860 | A | 9/1999 | Morgan et al. | |
| 5,971,515 | A | 10/1999 | Baker et al. | |
| 7,404,363 | B2 * | 7/2008 | Dunstan | 109/70 |
| 2009/0260552 | A1 * | 10/2009 | Dunstan | 109/70 |

FOREIGN PATENT DOCUMENTS

| | | |
|---|---|---|
| AU | A-11342/95 | 8/1995 |
| AU | 2000 12438 | 7/2000 |
| CA | 2325318 | 5/2002 |
| EP | 0145079 | 6/1985 |
| EP | 0607040 | 9/1997 |
| FR | 928207 | 11/1947 |
| FR | 2456198 | 5/1980 |
| WO | WO 96/29496 | 9/1996 |
| WO | WO 99/50519 | 10/1999 |
| WO | WO 00/79084 | 12/2000 |
| WO | WO 01/71140 | 9/2001 |
| WO | WO 02/059528 | 8/2002 |
| WO | WO 02/101185 | 12/2002 |

* cited by examiner

SECURITY DOOR AND FRAME CONSTRUCTION

CROSS-REFERENCE TO RELATED APPLICATION

This application is a divisional of U.S. patent application Ser. No. 10/530,467 filed Apr. 6, 2005 (now U.S. Pat. No. 7,404,363), which is a National Stage application of International Application No. PCT/AU2003/001321, filed on Oct. 8, 2003, which claims priority of Australian Application Serial No. 2002951987 filed on Oct. 9, 2002 and Australian Application Serial No. 2003902027 filed on Apr. 30, 2003.

BACKGROUND OF THE INVENTION

1. Field of the Invention

This invention concerns security door and frame construction and relates to safes.

2. Description of the Prior Art

Provision for security in doors include measures such as making the door and frame resistant to attack, providing special locks and adding multiple bolts which shoot into the frame. Such measures are effective in their own way, but intruders continually devise counter measures as new security equipment becomes available.

EP 0665 356 A1 discloses a safe wherein the door is wider than the door opening and lies behind the door opening when closed. The door is mounted on a vertical shaft which spans the door opening and reduces the effective opening width of the door. Pins extending from the interior face of the door engage slots in a mount which pivots on the shaft and a crank turned by a handle on the exterior face of the door slides the door on the mount. As the door clears the door opening, it is free to tilt inwards into the safe. The door swings on the mount and gives access to the safe interior. This mechanism reduces access to the safe interior and still requires a conventional bolt system to prevent the door from being forced inwards. The fall weight of the door is carried by the mount. The handle must displace the entire mass of the door sideways in order to clear the door opening.

SUMMARY OF THE INVENTION

This invention provides a security door construction comprising a door and door frame when a door is mounted on an offset hinge and the upright of the frame opposite the hinge has a slot capable of receiving the closing edge of the door, which upon closing slides into the slot and upon opening slides out of the slot.

The slot need only be shallow in that the admission of the margin of the closing edge of the door ensures a large area of engagement between door and frame and a correspondingly large force to displace the door.

The slot may be a 5-12 mm metal door such as is used for a safe. The timber door slot depth may be somewhat greater. The hinge axis is not coincident with the longitudinal edge of the door as in a conventional door. The hinge is offset from the door surface. The throw of the hinge may be 15-25 mm to give the required sliding entry and exit.

When the construction is used in a metal safe, the hinges may be paired conventionally but connected to the door face. The hinges may be connected to the door by a mounting member which provides the offset. The mounting member may be a tube or rod which maintains the hinge axis of the frame hinges parallel to the axis of the door hinges. The invention also provides the feature that the door frame has a frame rail behind the top edge and bottom edges of the rear face of the door, each rail has a slot means and the corresponding area on the rear face of the door have hook means for engaging and disengaging when the door closes and opens.

The top and bottom hinges may be protected by a hinge box fixed to the face of the door.

The door may have a conventional lock with a bolt and a keeper in the door frame. Multiple sliding pin locks may be fitted, but these are not necessary due to the extensive door margin engagement of the slot.

Door and frame construction of this type is particularly applicable to small box safes of the type used to store narcotics, cash and firearms, but is able to support doors on thicker metal safes. One application is now described pertaining to gun safes.

The uprights of the frame may be box-section styles. The term "box-section style" refers to how the upright is manufactured. A box-section style is made from bending sheet metal to form a hollow or open structure, as opposed to a solid structure. The door slot may be in the closing style. The body of the safe may be made of a single plate panel which is formed into a channel shape, including the box-section styles braced by a top plate and a bottom plate.

The hinge mounts may be mounted on the floor and the roof of the safe and extended to the safe interior. Each hinge may be part of a flange welded to the floor and roof. The hinges are joined in order to preserve the axis of rotation of the door which would otherwise sag randomly and tilt the plane of the door preventing orderly opening and closing.

The door may be a metal plate connected by a pair of door hinges to a pair of frame hinges. Mounts for the frame hinges are located adjacent the door support style and the gap between the door and style is closed up when the door is locked.

The frame hinges and the door hinges connected thereto are preferably protected by a box extending the full length of the door. The door may be stiffened by a box brace fixed to the interior face of the door. A conventional lock may shoot a bolt into the door closing style.

In some safes and security doors, security could be improved if their operation was made fail safe. The door construction described above may be modified to fail safe by fitting a conventional door closer inside the safe and provision of a thruster which slides the door into the slot. The sliding motion must be delayed until the door is in register with the slot otherwise the door will strike the closing style and never reach the slot. The construction may have a door closer arranged to swing the door shut and a biasing assembly associated with the door capable of sliding the door into the door slot when the door closer brings the door into register with the door slot.

The biasing assembly may impart a sliding motion to the door when the door lands on the closing surface parallel to the plane of the closed door against which the door swings to close before the door reaches the door slot. In such an arrangement, the biasing assembly preferably comprises a door handle with a crank inside the door which reacts against the rod or tube extending between the frame pivots, biasing means acting between the inside of the door and the crank in order to urge the door to slide toward the door slot, a link assembly connected to the crank which restrains the biasing means from imparting such slide motion to the door and a stop extending over at least part of the doors arc of swing which releases the link assembly at the end of the arc when the door registers with the door slot.

BRIEF DESCRIPTION OF THE DRAWINGS

Various embodiments are now described by way of example with reference to the accompanying drawings, in which.

DETAILED DESCRIPTION OF THE PREFERRED EMBODIMENTS

Figure 1:
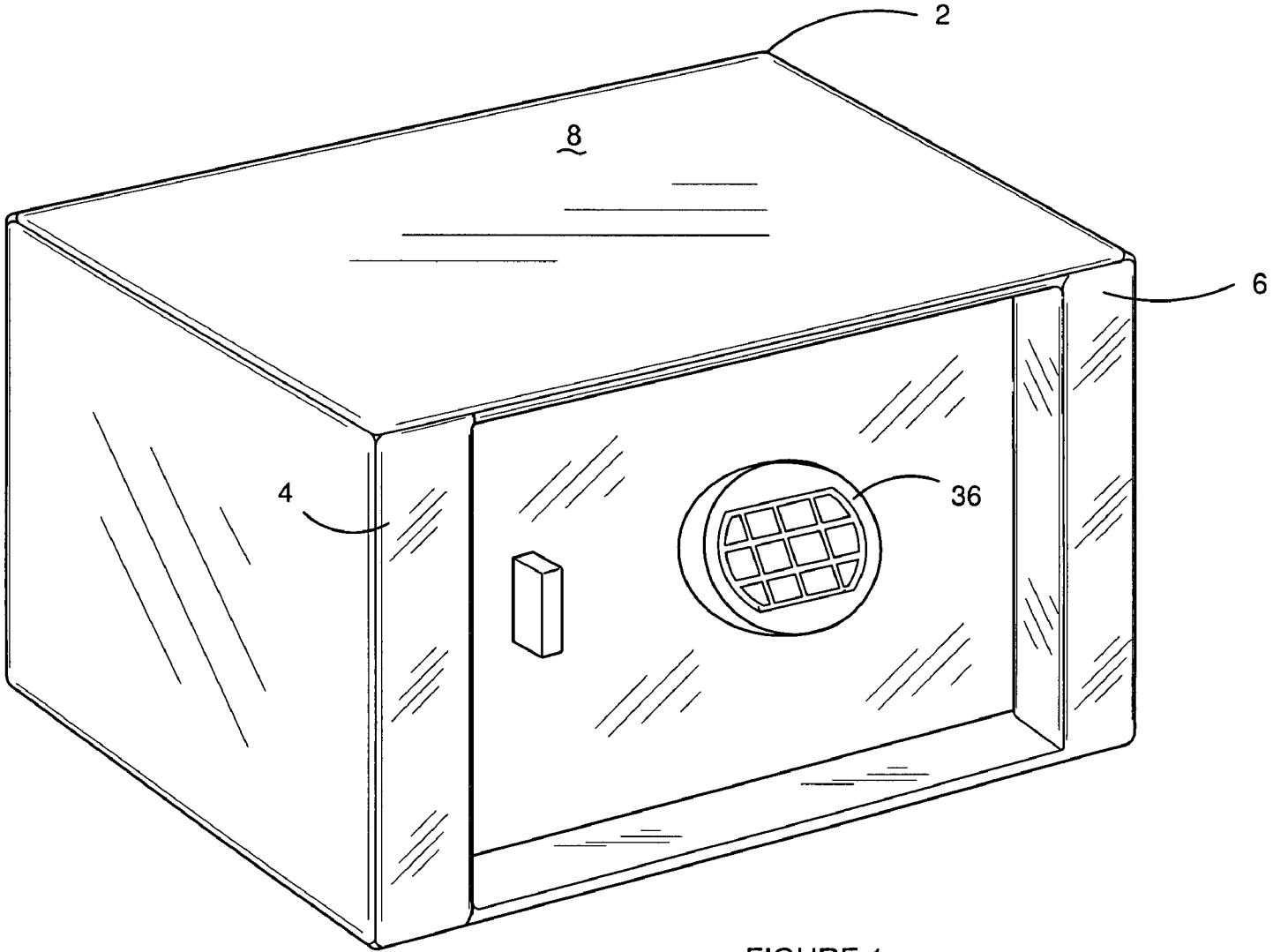
FIG. 1 is a perspective view of a small cash safe with a door closed.

Referring now to the drawings, the safe body 2 is made of 2 mm steel plate which is rolled into a channel section with the edges turned to form further channeled section style assemblies 4, 6. The safe is closed by a top plate 8 and a bottom plate 10 welded to the body. The styles are therefore resistant to being forced apart by a jacking force applied between them.

Figure 5:
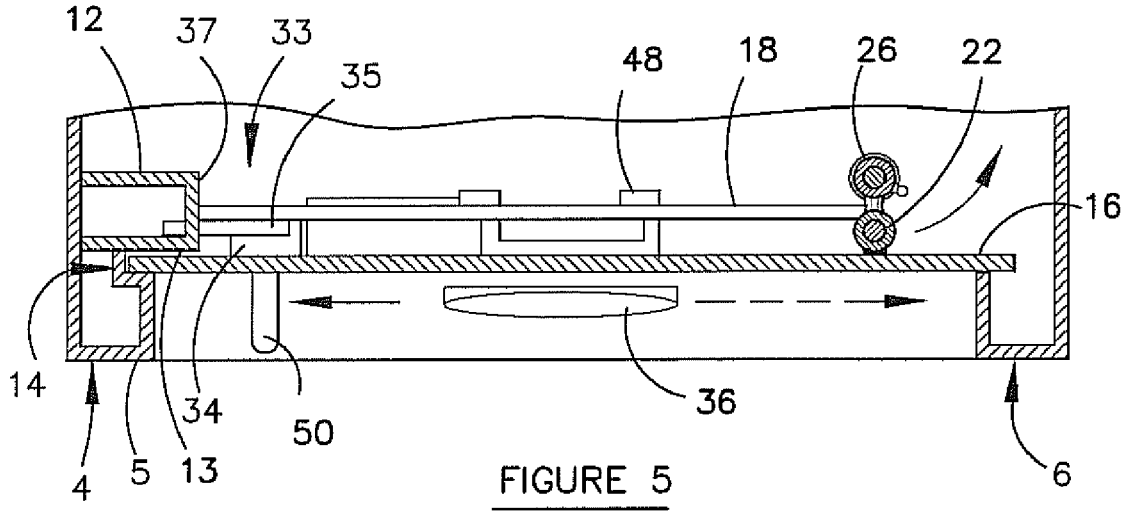
FIG. 5 is a sectional plan of the safe with the door closed.
Figure 6:
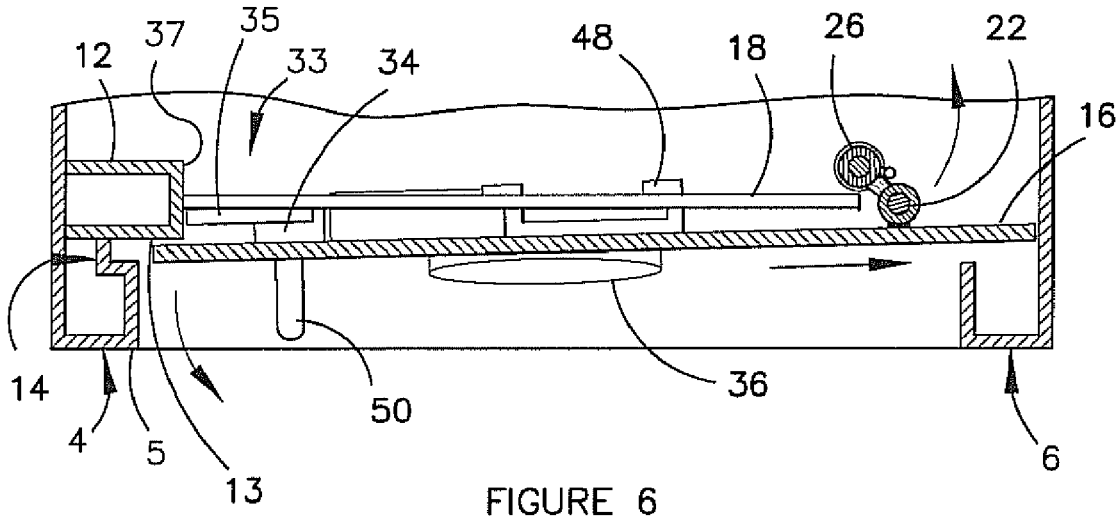
FIG. 6 is a sectional plan of the safe with the door moved sideways.
Figure 7:
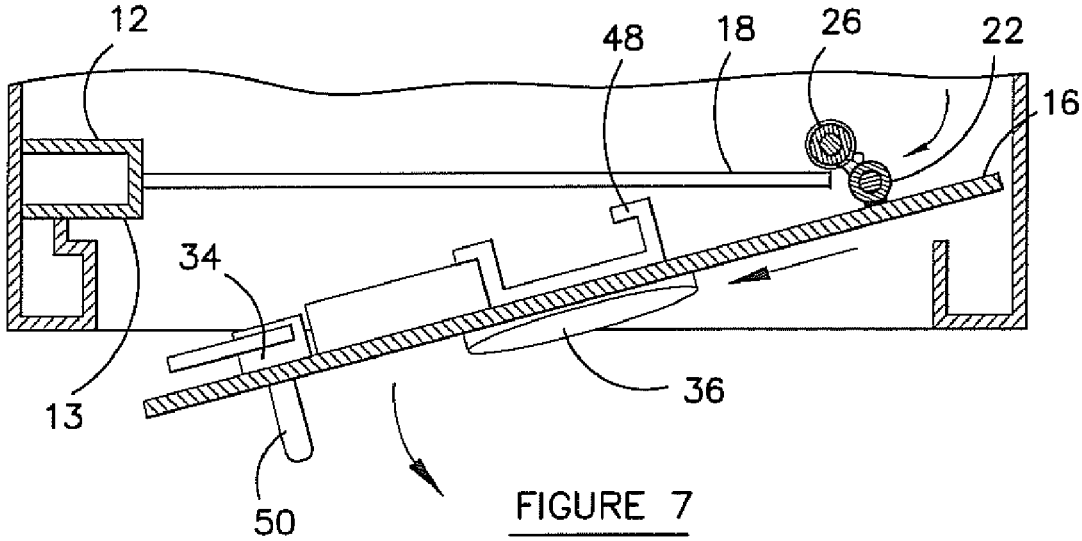
FIG. 7 is a sectional plan of the safe with the door opening.
Figure 8:
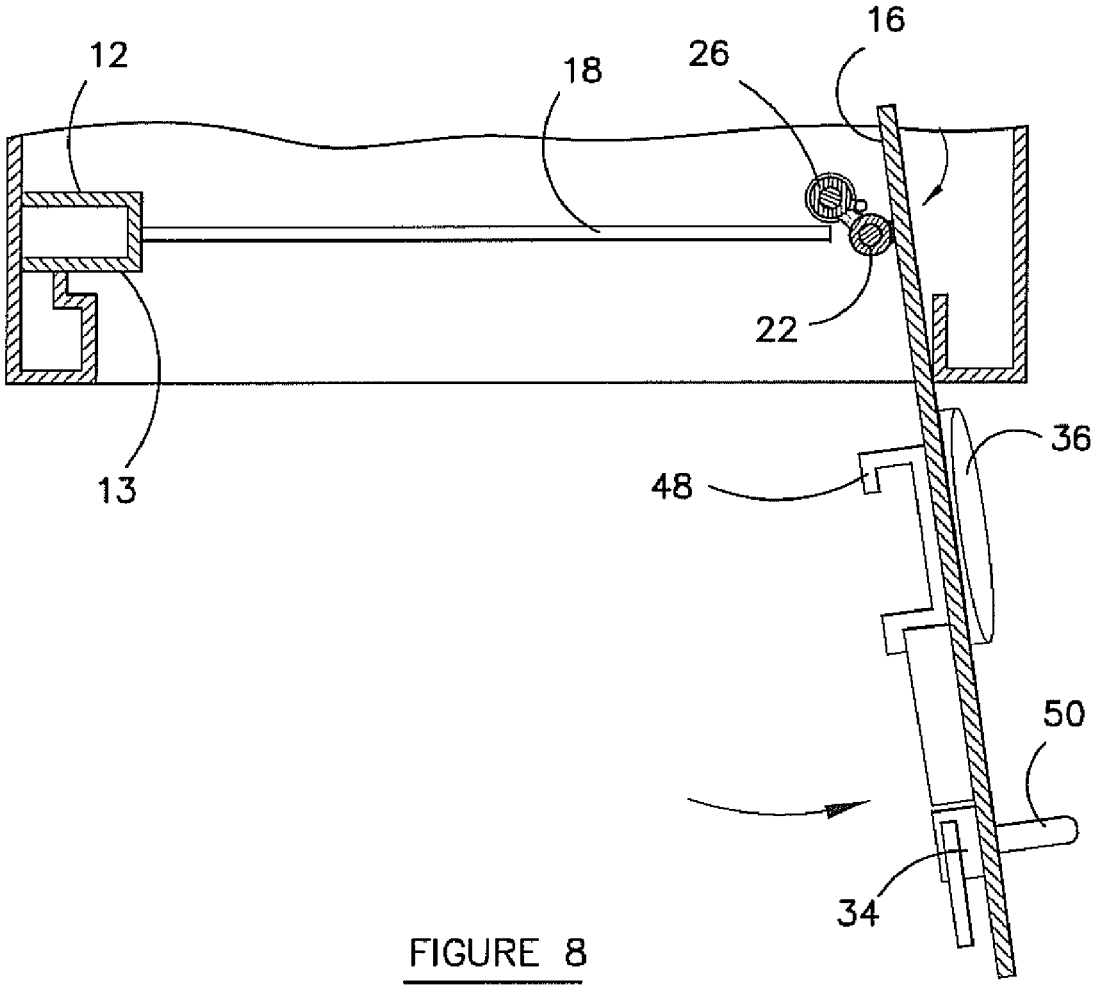
FIG. 8 is a sectional plan of the safe with the door fully open.

The channeled section style assembly 4 is composed in part by a closing style 5, which has three sides. The fourth side of channel section style assembly 4 (and 6) is formed by a box section steel closer or upright 12 welded to the body and projecting beyond the closing style 5. Upright 12 in FIGS. 5 and 6 is a box-section style since it is made from bending sheet metal and is a hollow structure as shown in the drawings. Upright 12 includes a closing surface 13 which is parallel to the plane of closed door 16. Closing surface 13 contacts the rear side of door 16. The 4 mm gap or slot 14 between the closer 12 and the style 5 extends the full length of the 3 mm steel plate door 16. Door 16 swings toward closing surface 13 causing door 16 to contact closing surface 13 thereby closing door 16 before door 16 reaches door slot 14.

A pair of flanges or upstands 18, 20 are inset and welded to the floor and roof. These support a pair of frame hinges 22, 24 which are welded at their ends to the roof and floor respectively. The door 16 tilts on a pair of door hinges 26, 28. The pins of the frame hinges 22, 24 are joined by rod 30. The pins of the door hinges 26, 28 are joined by rod 32.

A lock assembly 33 is shown in FIGS. 5 and 6. Lock assembly 33 includes a lock 34, a locking member 35 and a locking structure 37. Lock member 35 is connected to lock 34. Locking structure 37 is part of box action steel closer or upright 12 which is operably connected to locking member 35 when door 16 is in the locked or closed position. FIG. 6 shows locking member 35 in the open or unlocked position where locking structure 37 is not operably connected to locking member 35, while FIG. 5 shows the locked or closed position.

The sequence of opening the door is seen in FIGS. 5, 6, 7 and 8. The joining of rods 30 and 32 produces a throw in the hinge of about 20 mm and the door moves about half of this distance into slot 14. Lock 34 is conventional and is operated by a keypad 36. Without the rigidity of the joined rods 30, 32, the door would sag and resist opening and closing. This rigidity can be achieved variously by other geometries (see FIGS. 14 and 15).

Figure 3:
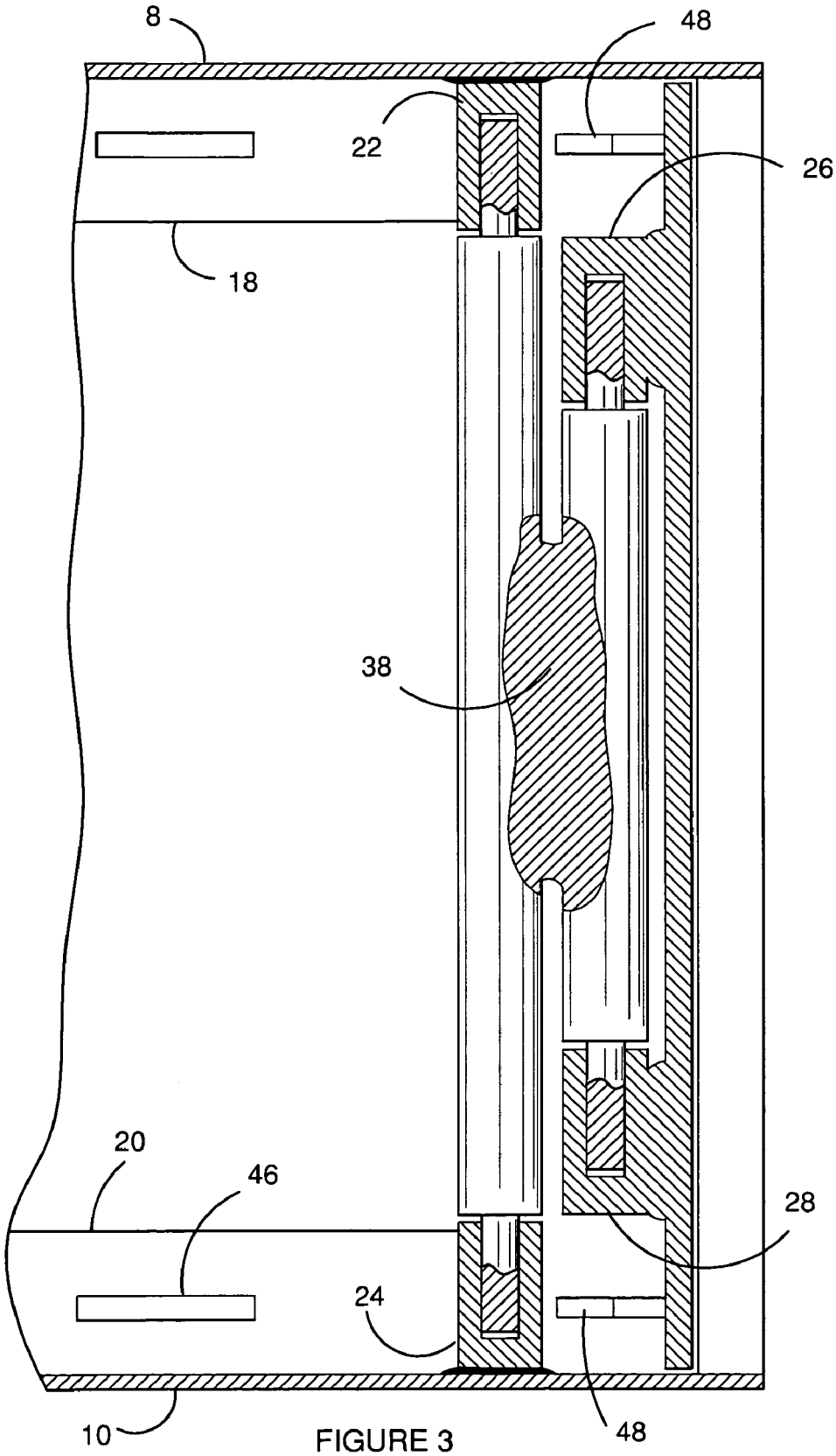
FIG. 3 is a front view of the hinge assembly of FIG. 2 from direction A.
Figure 4:
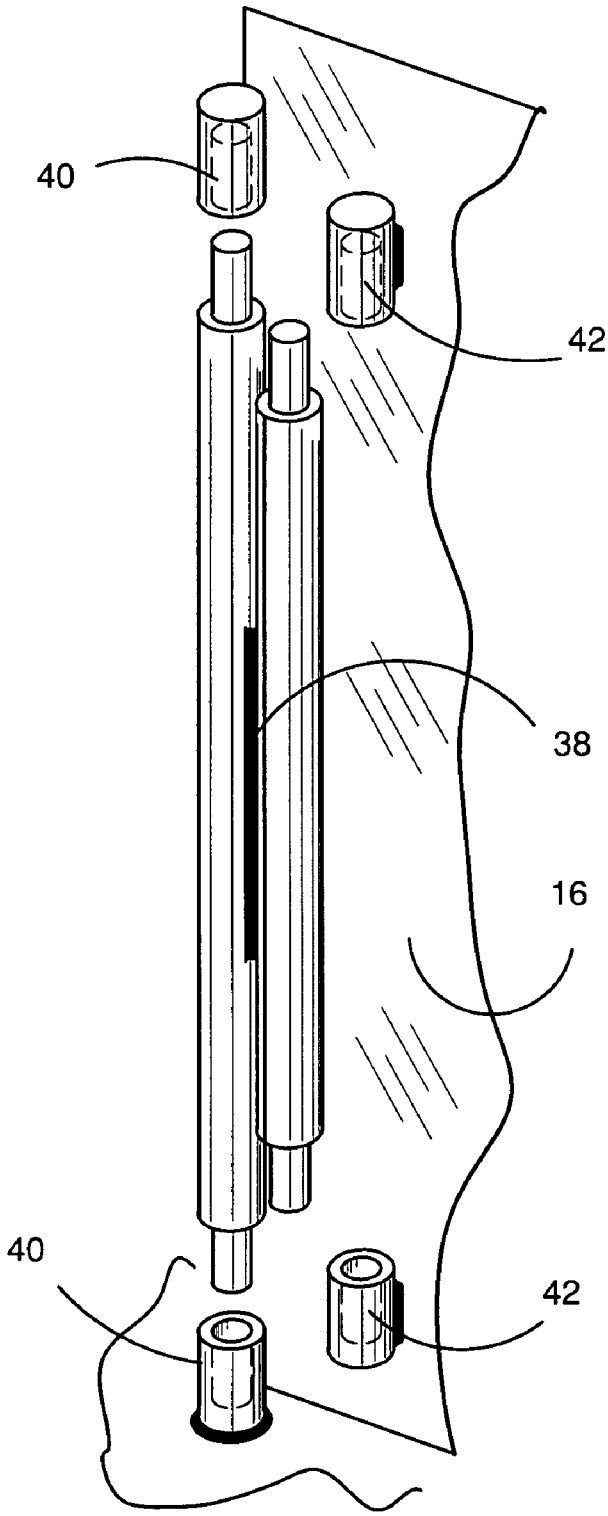
FIG. 4 is an exploded view of the hinge assembly of FIG. 3 after welding.

In FIGS. 3 and 4, the rods 30, 32 are joined or fixed by a common weld 38. In this version, the rods join the pins of the frame hinges 22, 24 to the pins of the door hinges 26, 28. In manufacture, the sequence is as follows.

The body 2 of the safe is rolled to form the edges of the door 16. The top and the floor are welded in position. The rods 30, 32 are welded together in a jig. The hinge collars are added and the hinge assembly is offered up to the door and welded to the door.

The door assembly is then offered up to a jig which also receives the body 2 and then upstands 18, 20 and frame hinges 22, 24 are welded to the body 2. Hinge pockets 40 abut the upstands 18, 20 and are welded to the roof and floor. The door assembly is offered up to the safe opening and pockets 42 abut the upstands 18, 20 and are welded to the roof and floor.

Upstands 18 and 20 have slots 46 for the reception of a pair of hooks 48 extending from door 16 which engage and disengage the slots 46 as the door 16 opens and closes. The hook and slot engagement is in addition to the conventional lock.

Figure 9:
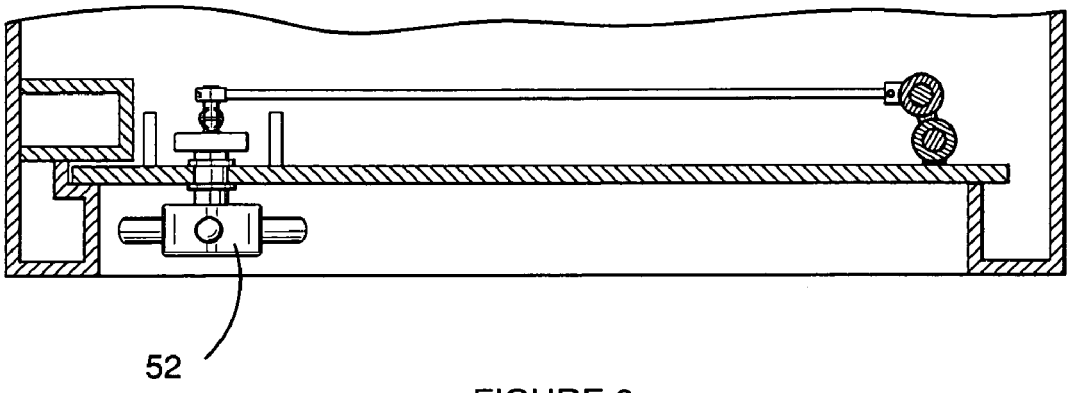
FIG. 9 is a sectional plan of the safe door with the handle for opening and closing the door.
Figure 10:
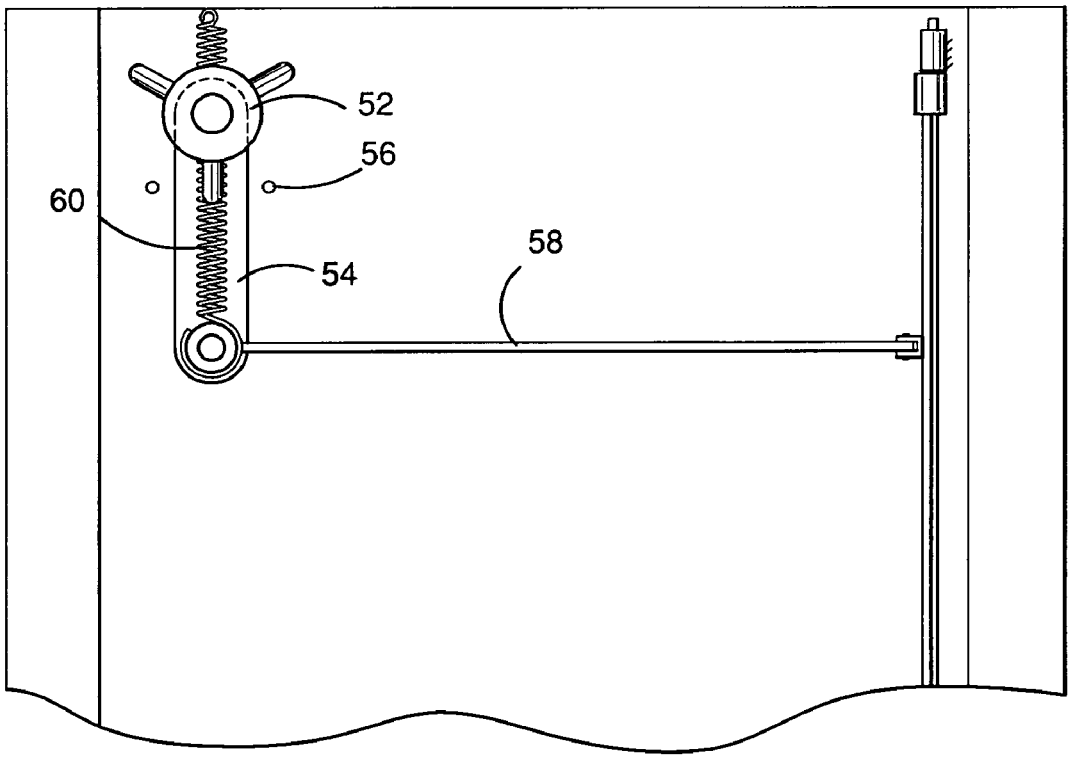
FIG. 10 is a front view of a fragment of the safe showing the handle linkage to the hinge assembly.

The sliding motion of the door is initiated by the person opening the safe, usually by exerting pressure on a D-handle 50 (FIGS. 5-8). As clearly shown in original FIGS. 5 and 6, the pressure or lateral force exerted by a person is shown as a solid arrow pointing at D-handle 50 which will move door 16 into a locked or closed position. In FIG. 6, a solid arrow pointing away from D-handle 50 describes the pressure or lateral force to move door 16 into an unlocked or open position. During this movement, door hinge 22 rotates in a counterclockwise direction as shown by a curved arrow in FIG. 6. Similarly, door hinge 22 rotates in clockwise direction during the locking movement in FIG. 5. In FIG. 9, a handwheel 52 mounted on door 16 turns a crank 54 between stops 56 and a link 58 reacts against rod 30 causing the door 16 to slide easily to LEFT or RIGHT. A spring 60 overcomes resistance to initial movement.

Figure 11:
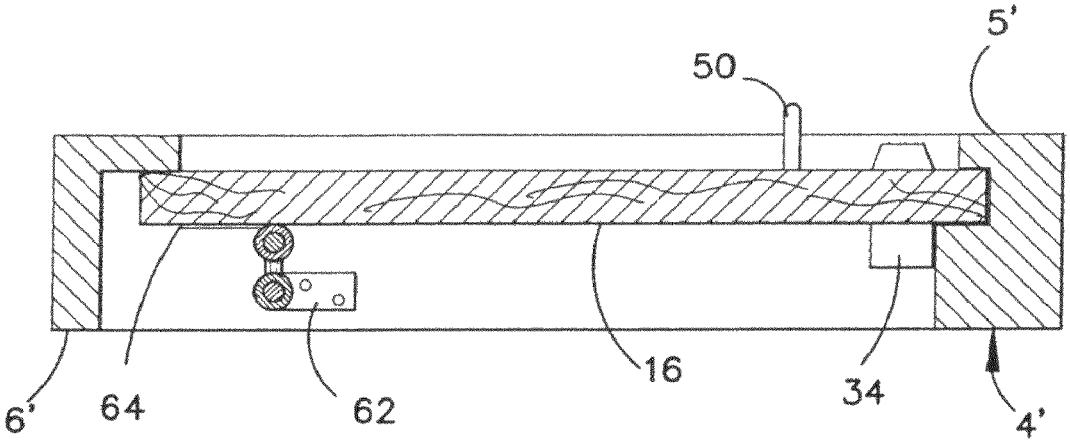
FIG. 11 is a sectional plan of a timber door and casing with the door closed.
Figure 12:
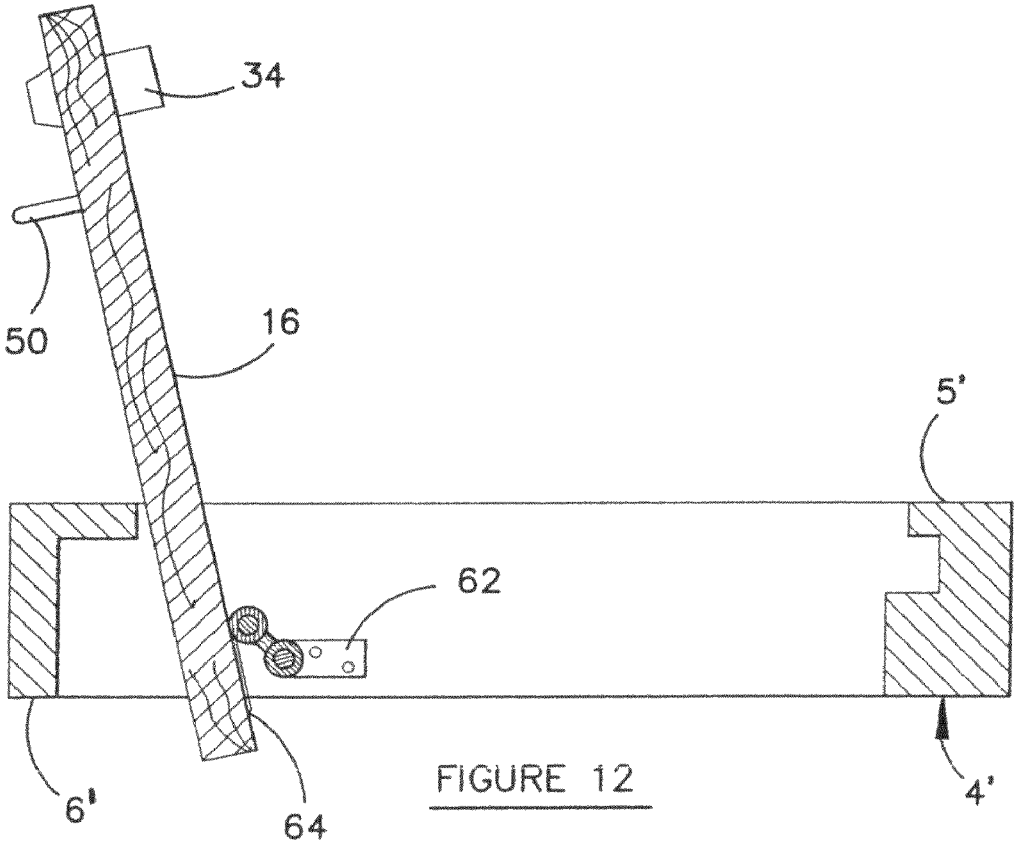
FIG. 12 is a sectional plan of the door and casing of FIG. 11 with the door open.

In FIGS. 11 and 12, the upstands are not used because a timber security door has a closing style 5' forming a part of a channeled section style 4' and an L-section support style 6'. Frame hinges 22, 24 are secured to the door casing by end plates 62 and the door hinges 26, 28 are screwed to the door by hinge leaves 64. Handle 50 and lock 34 are conventional.

Figure 13:
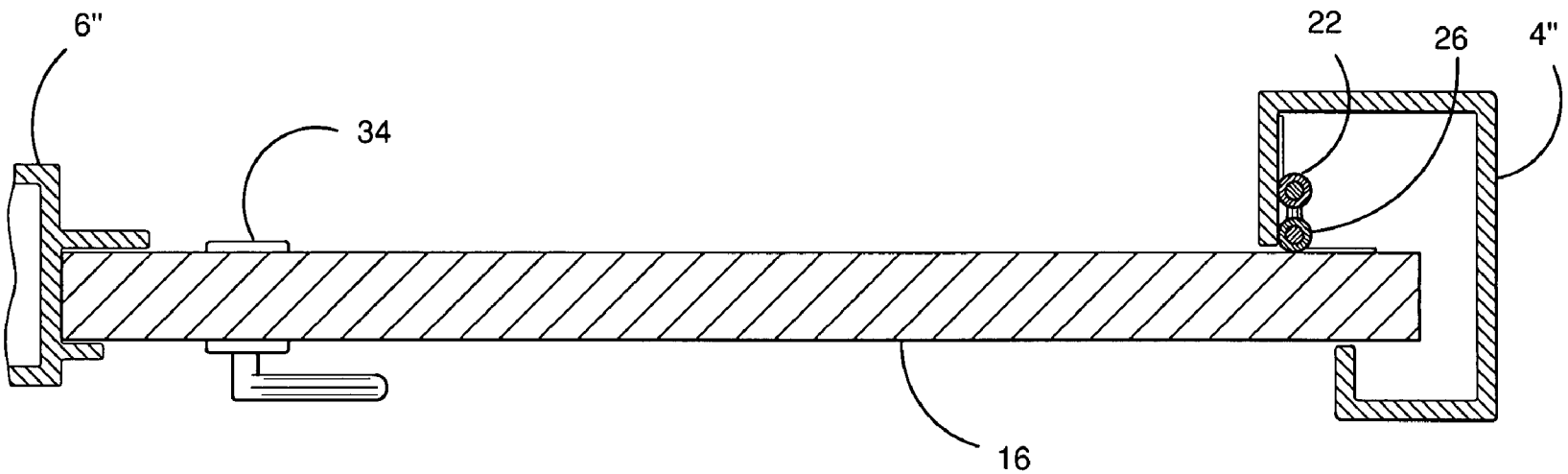
FIG. 13 is a sectional plan of an aluminum security door with the door closed.

In FIG. 13, the frame hinges 22, 24 (one shown) and door hinges 26, 28 (one shown) have hinge leaves 64 which are all accommodated inside support stud or closing style 4". Support stud 4" and closing stud or section style 6" are hollow aluminum extrusions. Lock 34 has diverging hooks which open out inside hollow stud 6.

Figure 14:
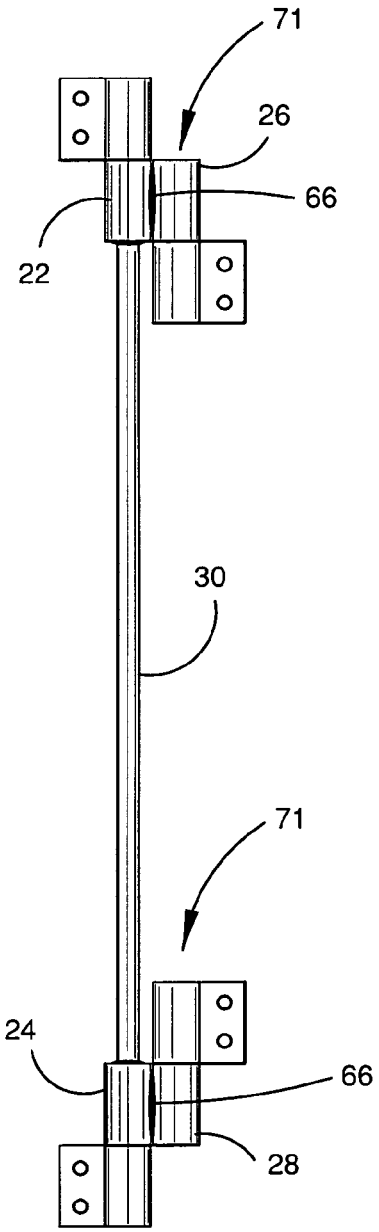
FIG. 14 is a front view of a hinge assembly for the door of FIG. 13 which is also supplied as a separate component for a suitable door and casing.

The aluminum security door shown in FIG. 13 has a hinge assembly 71 which may be sold separately and this is shown in FIG. 14. Rod 30 joins the pockets of frame hinges 22, 24 so they tilt in unison. The pockets of the hinges 22, 24 are joined to the pockets of the door hinges 26, 28 by welds 66.

Figure 15:
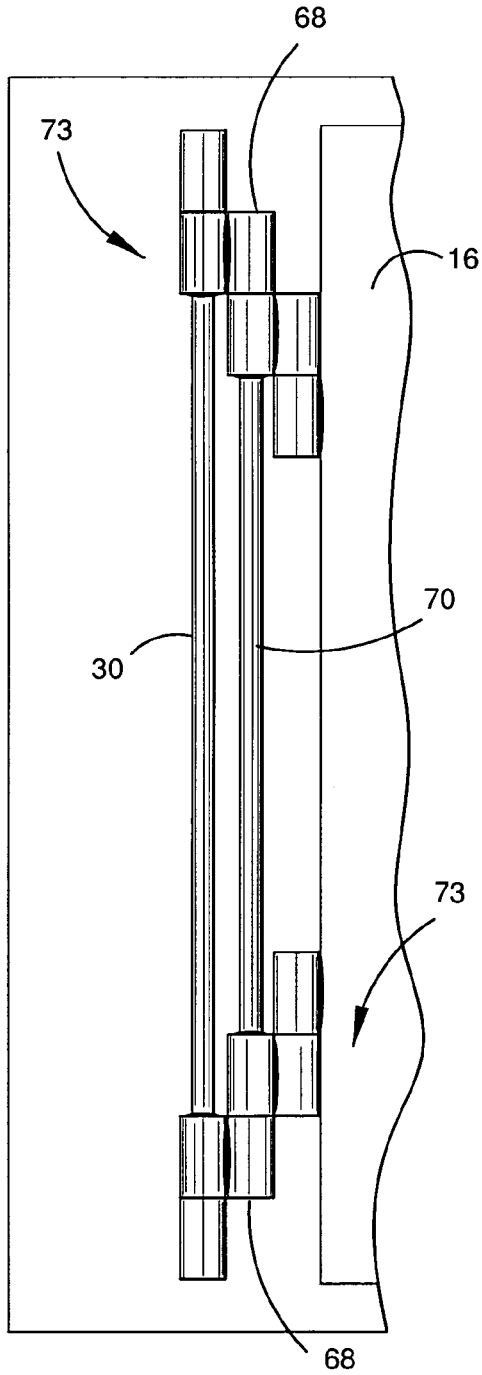
FIG. 15 is a front view of a triple hinge layout.

In FIG. 15, the throw of the hinge assembly is increased by using triple hinges 73 welded together as sets. The door is prevented from sagging by joining the door hinges to the door and the frame hinges by rod 30 and the intermediate hinges 68 by intermediate rod 70.

Figure 2:
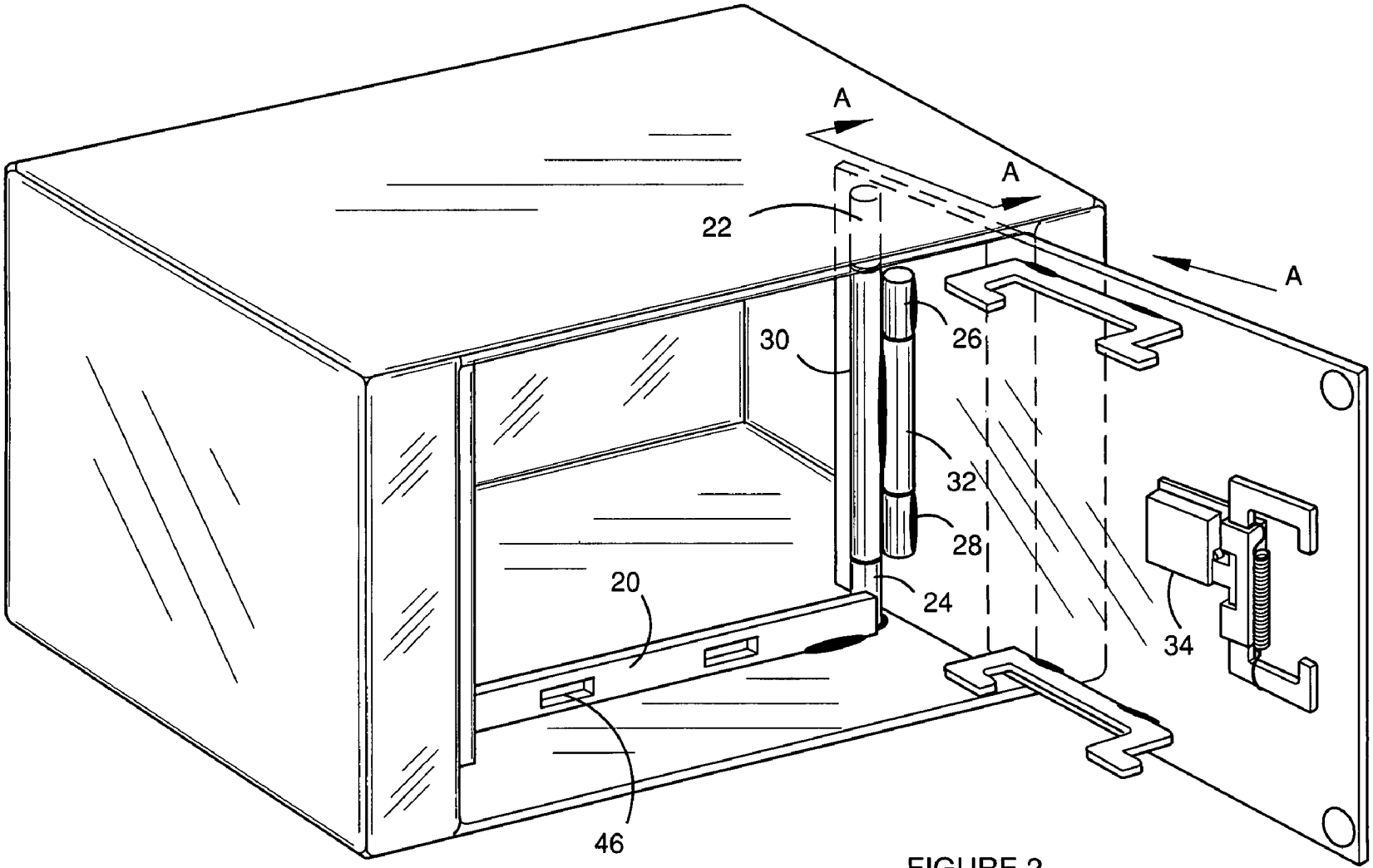
FIG. 2 is a perspective view of a safe of FIG. 1 with the door open.
Figure 16:
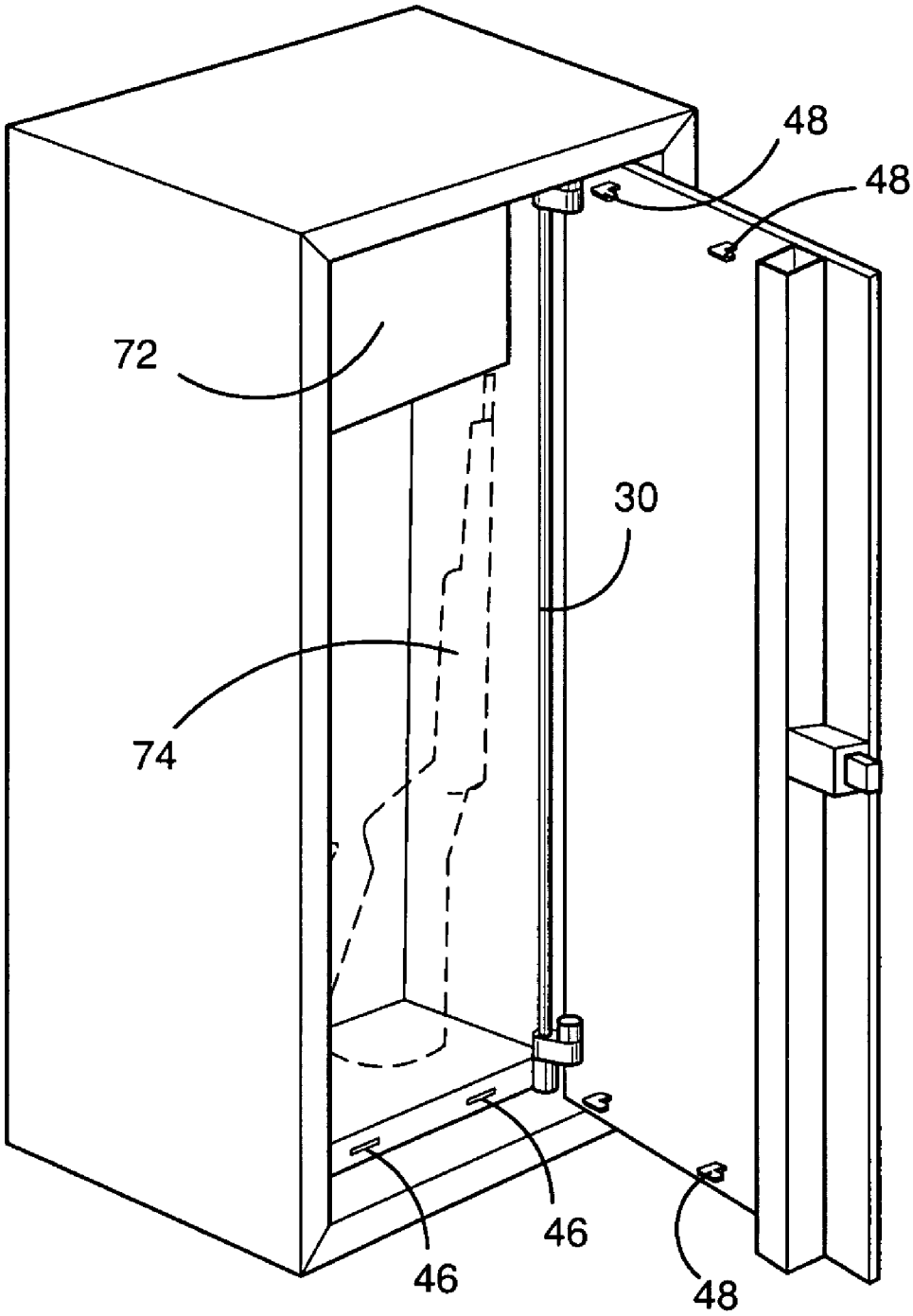
FIG. 16 is a diagrammatic perspective view of a gun safe showing the hinge assembly.

In a gun safe shown in FIG. 16, the pockets of the frame hinges 22, 24 are connected to the pins of the door hinges 26, 28. The hooks 48 and slots 46 engage and disengage as in the embodiment shown in FIGS. 2 and 3. An ammunition box 72 leaves space for a weapon 74.

Figure 17:
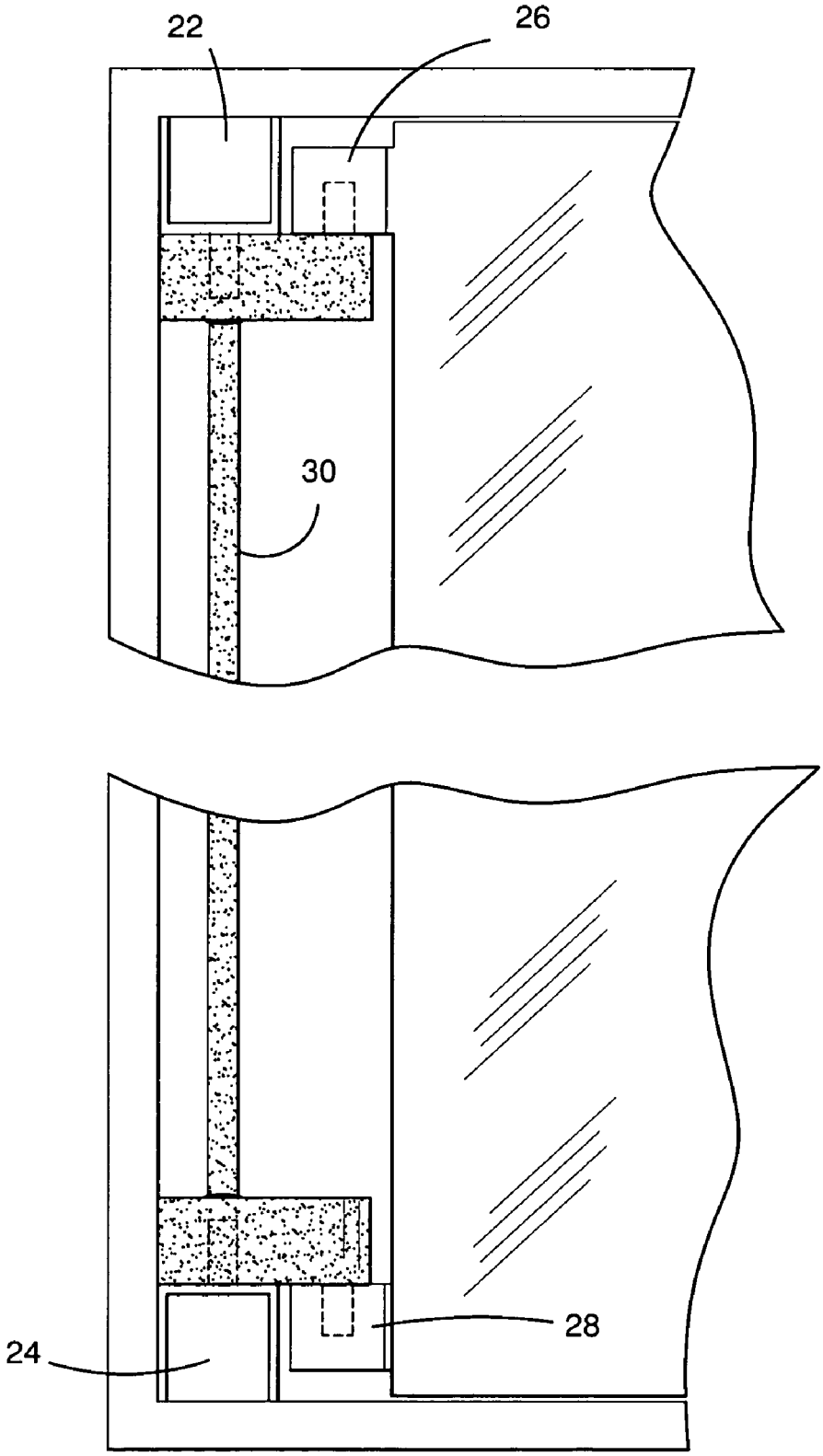
FIG. 17 is a front sectional view of the hinge of FIG. 16.

FIG. 17 assists in understanding the offset motion of the door. The components which are stippled lie in one plane and behave as a unitary part in the hinge assembly in the manner of a radius arm.

Figure 18:
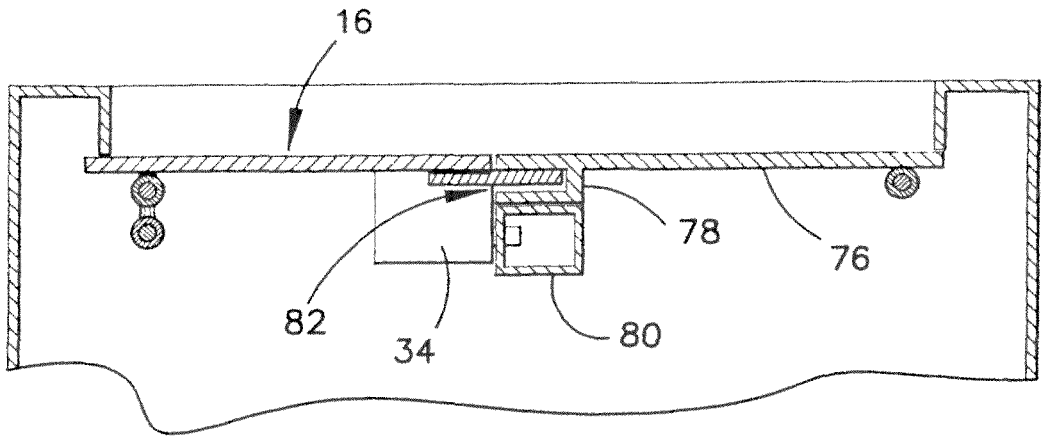
FIG. 18 is a sectional plan of a two door safe with a central pillar.

When a walk-in safe is constructed as for a cigarette and alcohol store, gunrooms, armories and the like, a conventional door 76 (FIG. 18) has a longitudinal pocket 78 at the closing edge which closes to the central pillar or central upright 80 and defines a slot 82 into which the sliding door 16 projects in order to allow lock 34 to operate.

Figure 19:
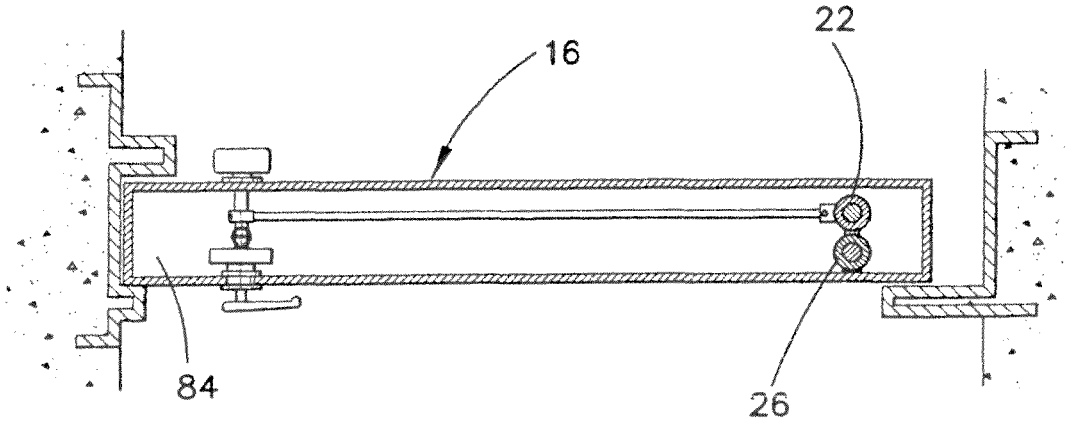
FIG. 19 is a plan view of a steel plate door.
Figure 20:
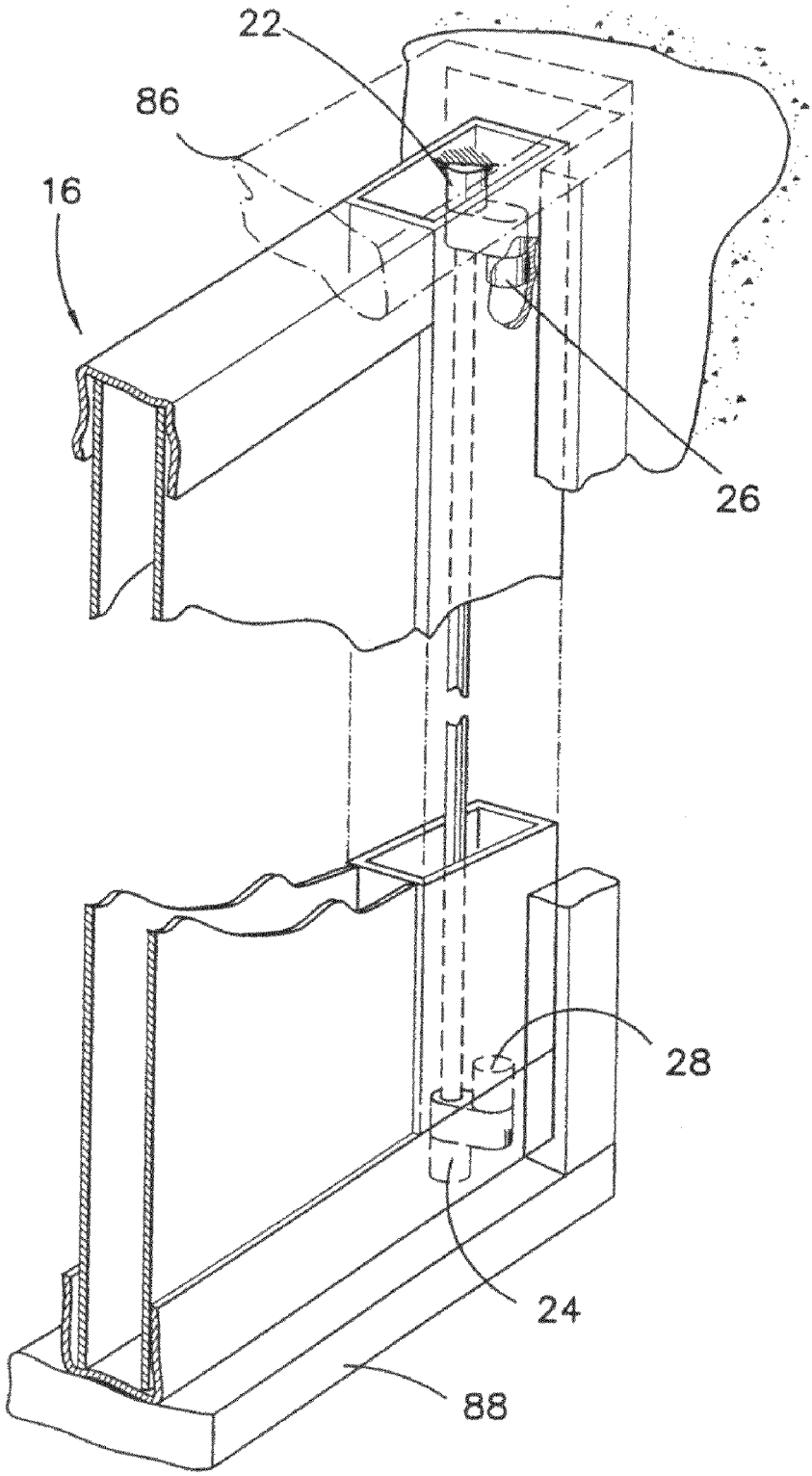
FIG. 20 is a perspective partly sectioned view of the upper part of the door shown in FIG. 19.

In FIGS. 19 and 20, steel plate door 16 has a hollow interior 84. The hinge assembly is housed in the interior, the door hinge 26 being welded to the inside of the door and the frame hinge 22 being welded to the door frame header 86 and the floor bar or sill 88.

Figure 21:
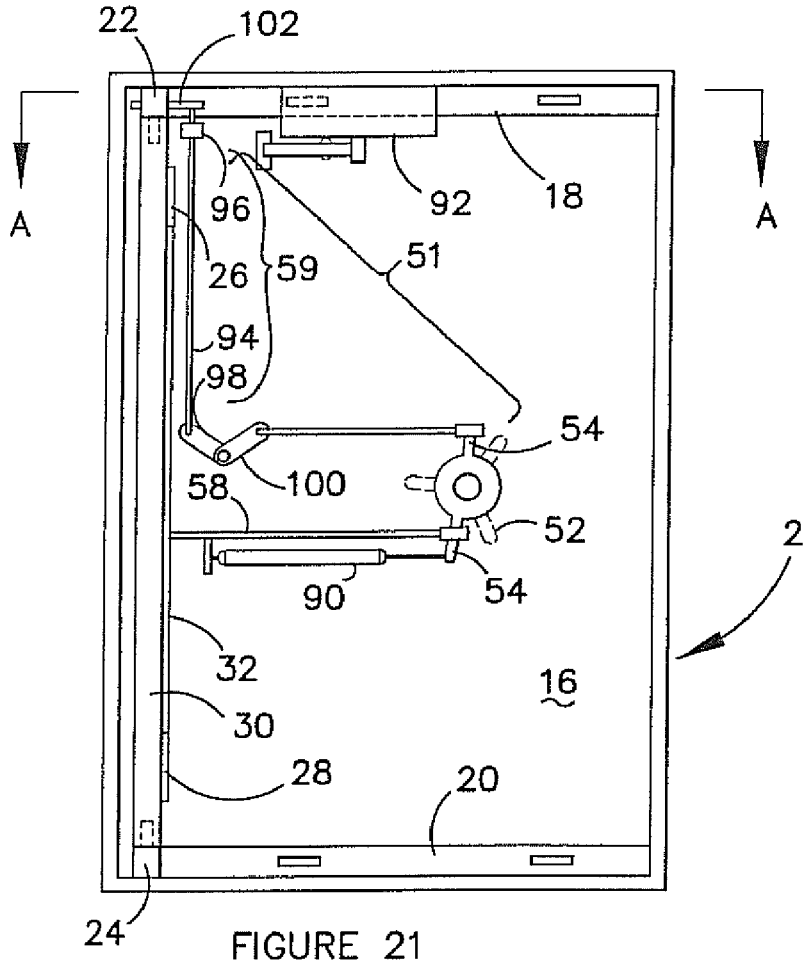
FIG. 21 is a rear view of a safe containing the mechanism looking through the safe with the back removed.
Figure 22:
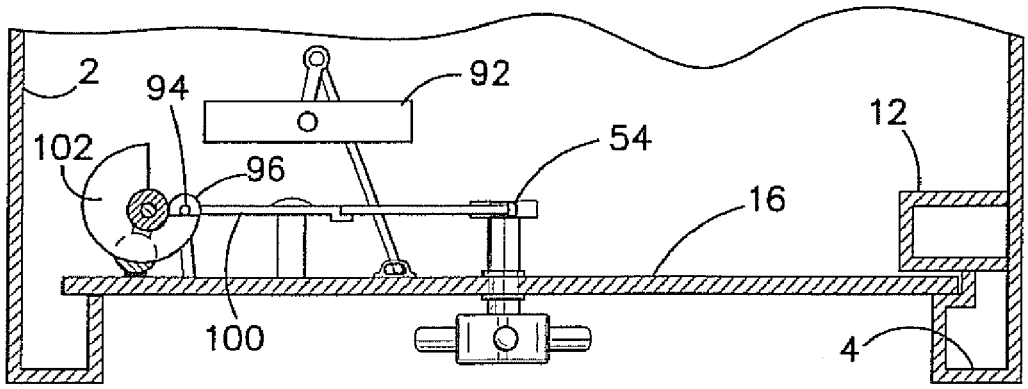
FIG. 22 is a plan of the safe of FIG. 21 looking from Direction A.

In FIGS. 21 and 22, the construction may have a door closer 92 arranged to swing the door 16 shut and a biasing assembly 51 associated with the door 16 capable of sliding the door 16 into the door slot 14 when the door closer 92 brings the door 16 into register with the door slot 14.

The biasing assembly 51 may impart a sliding motion to the door 16 when the door lands on the closing surface 13 parallel to the plane of the closed door 16 against which the door 16 swings to close before the door 16 reaches the door slot 14. In such an arrangement, the biasing assembly 51 preferably comprises a rotatable handle 52 with a crank 54 inside the door 16 which reacts through link 58 against the rod or tube 30 extending between the frame pivots 22, 24, biasing means acting between the inside of the door 16 and the crank 54 in order to urge the door 16 to slide toward the door slot 14, a link assembly 59 connected to the crank 54 which restrains the biasing means from imparting such slide motion to the door 16 and a stop 102 extending over at least part of the door's 16 arc of swing which releases the link assembly 59 at the end of the arc when the door 16 registers with the door slot 14. Link assembly 59 comprises rod 94, bell crank 100 and stop 102 as shown in FIG. 21 and discussed below.

Rotatable handle 52 connects to crank 54 and link 58 reacts against rod 30 causing the door to slide easily LEFT or RIGHT. Crank 54 is also acted upon by a biasing apparatus 90 which tends to move the door to the RIGHT thereby pushing the door into the door slot. In FIGS. 21 and 22, biasing apparatus 90 is a gas strut. A conventional door closer 92 is mounted inside the safe on the roof as shown.

The crank's 54 movement in response to the force of the gas strut 90 is resisted by a rod 94 which rises and falls in collar 96 under the influence of rigid connector 98 and bell crank 100. Rod 94 describes an arc when the door 16 opens and is prevented from rising and imparting the force of the gas strut 90 to the door 16 by contact with the underside of arcuate stop 102. The stop 102 is stationary and extends from frame hinge 22. When the door closer 92 swings the door 16 closed and the door 16 lands on the closing surface of style 4, rod 94 reaches the end of the stop 102 and suddenly rises under the force of the gas strut 90. The rotatable handle 52 is subjected to a force sliding the door 16 to the RIGHT and is free to move on the hinge assembly because the latter has an offset configuration.

When closed, the end of rod 94 projects above the arcuate stop 102. Turning the rotatable handle 52 pulls rod 94 under the stop 102 and swinging the door 16 open against the closer 92 retains the rod 94 under the stop 102. When the rotatable handle 52 is released, the door closer 92 swings the door 16 shut but the sliding motion is delayed until the door 16 registers with the slot 14.

In another version, the gas strut drives a pair of bolts into keepers in the closer 12.

We have found the advantages of the above embodiment to be:

1. The usual sites for the prying bar are absent in the construction.
2. No multiple entry bolts are necessary.
3. Doors of considerable mass are easily moved.
4. The fall width of the door is available.

It is to be understood that the word "comprising" as used throughout the specification is to be interpreted in its inclusive form, i.e. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

What is claimed:

1. A security door construction having opposing side portions and comprising:

an offset hinge assembly on one side portion of said security door construction;

a door having a top and a bottom, an inside and an outside, a closing edge and being slidably movable in a slide motion between an open position and a closed position;

a door frame having a top, a bottom, a closing style and an upright against which said door closes, said upright being located on the opposite side portion of said security door construction from said offset hinge assembly, and a door slot for slidingly receiving said closing edge of said door when said door moves into the closed position and for slidingly releasing said closing edge of said door when said door moves to the open position;

wherein said door is mounted behind said door frame on said offset hinge assembly, said offset hinge assembly being located behind said door in a space protected by said door, said offset hinge assembly further comprising:

a top door hinge operatively connected to the inside and near the top of said door;

a bottom door hinge operatively connected to the inside of and near the bottom of said door and being coaxial with said top door hinge;

a top door frame hinge operatively connected to said door frame;

a bottom door frame hinge operatively connected to said door frame and being coaxial with said top door frame hinge;

a top frame pin disposed in said top door frame hinge;

a bottom frame pin disposed in said bottom door frame hinge;

a first rigid member connected to said top frame pin and said bottom frame pin;

a top door pin disposed in said top door hinge;

a bottom door pin disposed in said bottom door hinge; and a second rigid member connected to said top door pin and said bottom door pin;

wherein said first rigid member and said second rigid member are fixed relative to each other; and a rotatable handle mounted on the outside of said door for opening and closing said door, said handle having a link located behind said door for reacting against said offset hinge assembly to cause said door to slide left or right when said handle is rotated.

2. A security door construction as claimed in claim 1, wherein said first and second rigid members are rods.

3. A security door construction as claimed in claim 1, wherein said first and second rigid members are welded to each other.

4. A security door construction as claimed in claim 1, further comprising:

a first upstand fixed to the top of said door frame; and a second upstand fixed to the bottom of said door frame;

wherein said top door frame hinge has a top end and said bottom door frame hinge has a bottom end, the top end of said top door frame hinge being fixed to the top of said door frame and to said first upstand, and the bottom end of said bottom door frame hinge being fixed to the bottom of the door frame and said second upstand.

5. A security door construction as claimed in claim 1, wherein said door slot is located between said closing style and said upright.

6. A security door construction as claimed in claim 1, wherein said door slot is located in said closing style.

7. A security door construction as claimed in claim 1, wherein the slide motion is 15-25 mm.

8. A security door construction as claimed in claim 1, further comprising:

at least one hook located on the inside of said door;

at least one hook slot located on said door frame for receiving said at least one hook located on the inside of said door, wherein said at least one hook engages and disengages said at least one hook slot when said door closes and opens respectively.

9. A security door construction as claimed in claim 1, wherein said door is substantially planar and said door frame has a closing surface parallel to the plane of the closed door, said door tilting against said closing surface to close before said door reaches said door slot.

10. A security door construction as claimed in claim 9, further comprising an L-section support style fixed to said door frame, wherein said closing style forms part of a channel section style assembly, and said door slot is defined by said closing style and said channel section style assembly.

11. A security door construction as claimed in claim 1, further comprising stops located on said door to limit the rotation of said handle, said handle rotating between said stops, and a spring located on said link to assist rotation of said handle by biasing the rotation toward one or the other of said stops.

12. A security door construction as claimed in claim 4, wherein said first upstand is welded to the top of said door frame and said second upstand is welded to the bottom of said door frame.

13. A security door construction as claimed in claim 4, wherein said top end of said top door frame hinge is welded to the top of said door frame and to said first upstand, and the bottom end of said bottom door frame hinge is welded to the bottom of said door frame and said second upstand.

14. A safe comprising:

a body made of a single plate panel formed into a channel section, said channel section including styles braced by a top plate and a bottom plate; and a security door construction having opposing side portions and comprising:

an offset hinge assembly on one side portion of said security door construction;

a door having a top and a bottom, an inside and an outside, a closing edge and being slidably movable in a slide motion between an open position and a closed position;

a door frame having a top, a bottom, a closing style and an upright, said door closing against said upright, said upright being located on the opposite side portion of said security door construction from said offset hinge assembly, and a door slot for slidingly receiving said closing edge of said door when said door moves into the closed position and for slidingly releasing said closing edge of said door when said door moves to the open position;

wherein said door is mounted behind said door frame on said offset hinge assembly, said offset hinge assembly being located behind said door in a space protected by said door; and a rotatable handle mounted on the outside of said door for opening and closing said door, said handle having a link located behind said door for reacting against said offset hinge assembly to cause said door to slide left or right when said handle is rotated.

15. A security door construction comprising a door having an internal face for protecting a space and a door frame, wherein the door is mounted behind the frame on an offset hinge assembly, the offset hinge assembly being located behind said door in the space protected by the door and having a door hinge fixed to a frame hinge, said offset hinge assembly comprising:

a first pair of hinges connected to the frame, a second pair of hinges connected to the door and connecting structure located behind the door connecting the first and second pairs of hinges for maintaining the hinge axis of the first pair of hinges parallel to the hinge axis of the second pair of hinges to prevent sagging of the door, the door hinge being attached to the internal face of the door and the frame hinge being attached to the door hinge to form a unitary assembly;

the frame comprising an upright opposite the door hinge, the upright having a door slot capable of receiving a closing edge of the door, the closing edge of the door sliding into the door slot in response to closing of the door and slides out of the door slot in response to opening of the door, and further comprising a rotatable handle mounted on the outside of said door for opening and closing the door, the handle having a link located behind said door for reacting against the offset hinge assembly causing the door to slide left or right when the handle is rotated.

16. A security door construction as claimed in claim 15, wherein each of the first pair of hinges and the second pair of hinges has a pair of opposing, coaxial pockets and a pair of coaxial pins in the respective pockets, and the connecting structure comprises a first rigid member connecting the pockets of one of the first and second pairs of hinges to the pins of the other of the first and second pairs of hinges.

17. A security door construction as claimed in claim 15, wherein a second rigid member connecting the pins of one of the first and second pairs of hinges to the pins of the other of the first and second pairs of hinges.

18. A security door construction as claimed in claim 15, wherein each of the first pair of hinges and the second pair of hinges has a pair of opposing coaxial pockets, and the connecting structure is a rigid member connecting the pockets of one of the first and second pairs of hinges to the pockets of the other of the first and second pairs of hinges.

19. A security door construction as claimed in claim 16, wherein the first rigid member is a rod or tube.

20. A security door construction as claimed in claim 15, wherein each of the first pair of hinges and second pair of hinges comprises opposing, coaxial pockets, and the pockets of one of the first and second pairs of hinges are fixed to the adjacent pockets of the other of the first and second pairs of hinges, and the connecting structure comprises a rod or tube connecting the first and second pairs of hinges.

21. A security door construction as claimed in claim 15, wherein each of the first pair of hinges and second pair of hinges has opposing, coaxial pockets, each pocket having a body and an end, the frame has a top horizontal face and a bottom horizontal face, an upstand welded to one of the top horizontal face and the bottom horizontal face of the frame, and wherein each pocket of the first pair of hinges fixed to the frame is welded at the end of the pocket to the top and bottom horizontal face of the frame, and the body of the pocket of the first pair of hinges is additionally welded to the upstand welded to the top or bottom face of the frame.

22. A security door construction as claimed in claim 15, wherein the frame comprises more than one upright, and the uprights are box section styles.

23. A security door construction as claimed in claim 22, wherein the door slot is in a closing style.

24. A security door construction as claimed in claim 22, wherein the frame is part of a safe, the safe having a body made of a single plate panel, the panel being formed into a channel section, the channel section including box section styles braced by a top plate and a bottom plate.

25. A security door construction as claimed in claim 15, wherein the slide has a motion of 13-25 mm.

26. A security door construction as claimed in claim 15, said door having a rear face, wherein the door frame has a frame rail upstand behind the top and bottom edge of the rear face of the door, each rail has a slot structure and the rear face of the door has a corresponding area corresponding to the slot structure, and hook structure on the corresponding area for engaging and disengaging the slot structure when the door closes and opens.

27. A security door construction as claimed in claim 15, wherein the door frame has a closing surface parallel to the plane of the closed door, the door tilting against the closing surface as the door closes before the door reaches the door slot.

28. A security door construction as claimed in claim 27, wherein the door frame comprises a closing frame member, the closing frame member comprising a closing style, a channel section style assembly and an L-section support style fixed to the frame for cooperating with the closing style to define the slot for the door.

29. A security door construction as claimed in claim 19, wherein the link reacts against the rod or tube to cause the door to slide left or right when the handle is rotated.

30. A security door construction as claimed in claim 15, wherein the door comprises a pair of stops for limiting rotation of the handle and a spring operatively connected to the handle, biasing the rotation of the handle to one or the other of the pair of stops to assist the rotation of the handle.

31. A security door construction as claimed in claim 15, wherein the door has a door casing, the door casing having a header and a sill, the second pair of hinges being fixed to the door.

32. A security door construction as claimed in claim 15, wherein the door is a screen door made of hollow metal extrusions, and the first pair of hinges is fixable to the frame and the second pair of hinges is fixable to an edge of the door.

33. A security door construction as claimed in claim 31, wherein at least part of the second pair of hinges is at least partly located in the door.

34. A security door construction as claimed in claim 33, wherein the door has a support edge with a tunnel at or near the support edge, and the second pair of hinges is housed in the tunnel.

35. A security door construction as claimed in claim 15, and further comprising a door closer arranged to bias the door shut and a biasing assembly associated with the door capable of sliding the door into the door slot when the door closer brings the door into registry with the door slot.

36. A security door construction as claimed in claim 35, wherein the frame has a closing surface adjacent the door slot, and the security door construction further comprises a delaying apparatus for delaying the door movement caused by the biasing assembly until the door lands on the closing surface of the frame adjacent the door slot.

37. A security door construction as claimed in claim 35, further comprising a rod or tube extending between the first pair of hinges, wherein part of the movement of the door is an arc, the arc having an end for placing the door in registration with the door slot, the biasing assembly comprises a door handle, a crank mounted inside the door for reacting against the rod or tube extending between the first pair of hinges, a biasing apparatus acting between the inside of the door and the crank for urging the door to slide toward the door slot, a link assembly connected to the crank for restraining the biasing assembly from imparting the slide motion to the door and a stop extending over at least part of the arc of swing of the door for releasing the link assembly at the end of the arc when the door registers with the door slot.

38. A security door construction as claimed in claim 37, wherein the stop is an arcuate stop, and the arcuate stop is concentric with the hinge axis of the first pair of hinges.

39. A security door construction as claimed in claim 15, wherein said door construction is part of a safe.

40. A security door construction as claimed in claim 31, wherein the door is a pre-hung door.

41. A security door construction as claimed in claim 32, wherein at least part of the second pair of hinges is at least partly located in the screen door.

42. A security door construction as claimed in claim 41, wherein the door has a support edge with a tunnel at or near the support edge, and the second pair of hinges is housed in the tunnel.

* * * * *